US006435891B1

(12) United States Patent
Beck, Jr. et al.

(10) Patent No.: US 6,435,891 B1
(45) Date of Patent: Aug. 20, 2002

(54) MECHANICALLY ASSISTED BLIND MATE ELECTRICAL CONNECTOR

(75) Inventors: Hoy Smith Beck, Jr., Lexington, NC (US); Michael John Christiansen, Auburn Hills, MI (US); Keith Richard Foltz, Oberlin; John Mark Myer, Millersville, both of PA (US)

(73) Assignee: Tyco Electronics Corporation

( * ) Notice: Subject to any disclaimer, the term of this patent is extended or adjusted under 35 U.S.C. 154(b) by 0 days.

(21) Appl. No.: 09/698,565

(22) Filed: Oct. 27, 2000

Related U.S. Application Data

(60) Provisional application No. 60/161,996, filed on Oct. 28, 1999.

(51) Int. Cl.[7] ..... H01R 13/64
(52) U.S. Cl. ..... 439/248; 439/364; 439/587
(58) Field of Search ..... 439/248, 902, 439/595, 364, 587, 246, 247, 547–549

(56) References Cited

U.S. PATENT DOCUMENTS

| | | | | | |
|---|---|---|---|---|---|
| 4,664,456 | A | | 5/1987 | Blair et al. | |
| 4,684,190 | A | * | 8/1987 | Clark et al. | 439/587 |
| 4,761,144 | A | | 8/1988 | Hunt, III et al. | 439/545 |
| 4,921,435 | A | | 5/1990 | Kane et al. | 439/248 |
| 4,963,098 | A | | 10/1990 | Myer et al. | 439/76 |
| 5,071,369 | A | * | 12/1991 | Denlinger et al. | 439/595 |
| 5,127,852 | A | | 7/1992 | Cravens et al. | 439/545 |
| 5,139,431 | A | * | 8/1992 | Saitoh et al. | 439/364 |
| 5,151,045 | A | | 9/1992 | Cravens et al. | 439/271 |
| 5,228,865 | A | | 7/1993 | Douty et al. | 439/247 |
| 5,378,173 | A | | 1/1995 | Hashizawa | 439/701 |
| 5,466,171 | A | | 11/1995 | Bixler et al. | 439/378 |
| 5,575,673 | A | | 11/1996 | Dahlem et al. | 439/248 |
| 5,649,834 | A | | 7/1997 | Allison et al. | 439/247 |
| 5,829,910 | A | | 11/1998 | Kameyama | 403/329 |
| 5,888,093 | A | | 3/1999 | Polgar et al. | 439/546 |
| 5,910,026 | A | * | 6/1999 | Geib et al. | 439/471 |
| 5,993,255 | A | * | 11/1999 | Yurko | 439/595 |

* cited by examiner

*Primary Examiner*—Brian Sircus
*Assistant Examiner*—Son V. Nguyen

(57) ABSTRACT

An electrical connector assembly (2) includes a first connector in the form of a printed circuit board header (10) and a second connector in the form of a plug connector that can be attached to wires in a wiring harness. One of the connectors is mounted in an opening (6) in a panel so that the connector is free to float in an X and a Y direction. A protruding alignment post (30) on one connector is received within an alignment cavity (70) on the other connectors so that the connector positioned in the panel opening (6) will shift laterally so that pin terminals (22) in one connector will be aligned with receptacle terminals (50) in terminal cavities of the other connector will be aligned before they are mated. A mechanical assist member, such as a bolt (90) extends through a central opening (32) in the alignment post (30) and through the mating alignment cavity (70) to increase the force available to mate the two connectors.

17 Claims, 4 Drawing Sheets

MECHANICALLY ASSISTED BLIND MATE ELECTRICAL CONNECTOR

This application claims the benefit of provisional application No. 60/161,996 filed Oct. 28, 1999.

FIELD OF THE INVENTION

This invention relates to mating electrical connectors that each include mating terminals. More particularly these connectors are blind mate connectors in which mating alignment members align the mating terminals before the terminals come into contact to prevent damage to the terminals during mating. A mechanical assist member is also employed to overcome the mating forces that are in large part due to the large number of terminals in the two connectors.

BACKGROUND OF THE INVENTION

Blind mating connectors in which one of the connector is free to laterally float to align the connectors for mating are commonly used in many applications. Mechanically assisted connectors are probably more common because the force to mate many high count connectors is greater than that recommended for hand assembly. However, the prior art does not appear to include any mechanically assisted blind mating connectors.

U.S. Pat. No. 4,963,098 discloses one version of a blind mating electrical connector assembly. That connector employs an alignment post centrally located in a printed circuit board header with a plurality of pin terminals surrounding the alignment post. A frame having a cavity into which the alignment post can be inserted is mounted in a panel cutout which permits limited lateral movement of the frame during alignment. Two electrical connectors terminated to wires are mounted in the frame and mutual engagement between the alignment post and the frame cavity aligns the header pins with receptacle terminals located in the connector housings mounted in the frame. However, this connector does not include any means for mechanically assisting or amplifying the force available to mate the two header to the two plug connectors mounted in the frame.

Conversely, U.S. Pat. No. 5,151,045 discloses another connector that employs a bolt or jackscrew as a mechanical assist member for mating two connectors, but the two connectors cannot be blind mated in any reliable manner. In this prior art connector the bolt is located in a plug connector which is then attached to a printed circuit board header located in a module that is attached to a fixed structure. Any necessary alignment can therefore be easily accomplished by the installer. Although bolt mounted connector assemblies are quite common, conventional connectors of this type do not provide for blind mating or for significant float of a connector mounted in a panel opening.

SUMMARY OF THE INVENTION

High count electrical connectors containing a relatively large number of terminals require higher mating forces than connectors having only a few mating terminals. Connectors employing contacts with a relatively high current carrying capacity or requiring high mating forces or significant wiping action further increase the mating force. These high count connectors are typically used to connect wire harnesses or to connect wires in a wire harness to an external component. When the mating force is too great for manual assembly, some form of mechanical assistance is necessary.

The installation of electrical components and harnesses in automotive applications frequently require a large number of terminals to be mounted in a single connector housing to form high count connectors or as part of multicomponent chunks. Overall assembly is simplified by reducing the number of electrical connectors that must be connected and by reducing the number of connectors that must be assembled, hopefully the number of wiring errors can be reduced.

In a number of automotive applications, one of the connectors is mounted in a panel and this previously mounted connector must be free to float when mated with a second connector or with a electrical component or subassemblies. This often requires blind mating of the connectors. For example, automotive applications in which it is often desirable to include a blind mating capability for electrical connector assemblies include connector assemblies used in door trim panels, floor consoles and headliners. One reason for permitting a panel mount connector typically used in these applications to float during mating is the difficulty of precisely positioning such panel mount connectors in assemblies where assembly tolerances must be kept as large as possible so that the assembly will be relatively uncomplicated.

A principal object of this invention is to combine both blind mating and mechanical assist capabilities in the same electrical connector. However, this combination must be accomplished in a manner that will prevent damage to free standing terminal pins in one of the connectors during mating. Damage can occur when the two connectors are skewed when initially mated and the plug connector scoops or bends the ends of the free standing pins. The instant invention accomplishes these and other objectives without resorting to complicated configurations that would not be suitable for use in automotive applications.

These objections can be realized by an electrical connector assembly comprising first and second electrical connectors. One of these connectors is mounted in a panel such that the one electrical connector floats in both an X and a Y direction. A male alignment member on one of these electrical connectors, either the one mounted in the panel or the mating connector. A female alignment member is located in the other electrical connector. The male and female alignment members are matable such that, during mating of the male and female alignment members the electrical connector mounted on the panel is free to move in an X and a Y direction into alignment with the other electrical connector. The electrical connector assembly includes an opening extending through the male alignment member for receipt of mechanical assist means for applying additional mating force to assist mating of the first and second electrical connectors. Typically a bolt is employed as the mechanical assist member. Both the male alignment post or protrusion and the alignment cavity in the other connector are located in the center of terminal arrays in the two mating connectors.

DETAILED DESCRIPTION OF THE INVENTION

Figure 1:
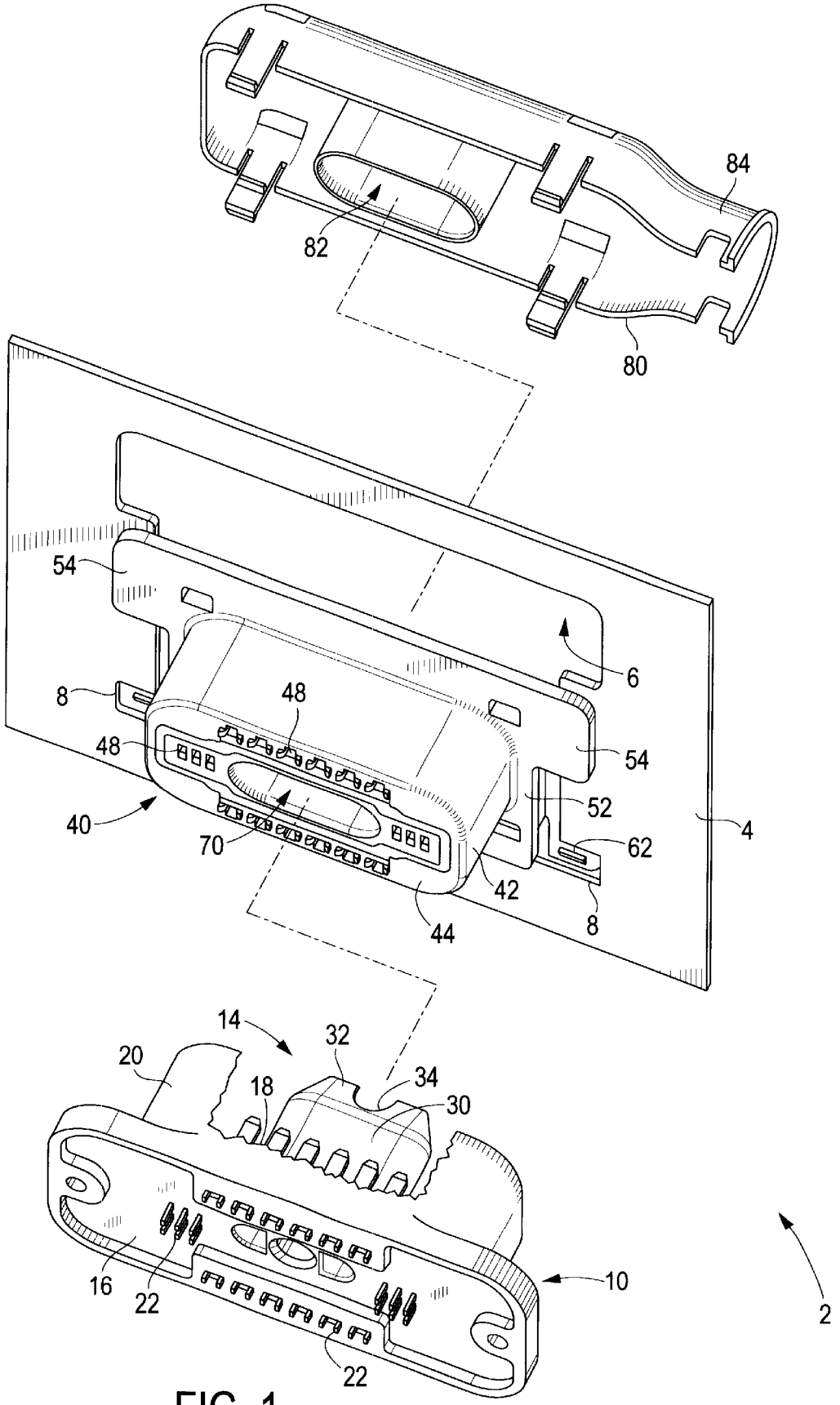
FIG. 1 is a three dimensional view of the connector assembly according to the preferred embodiment of this invention showing one connector mounted in a panel opening or cutout.

The electrical connector assembly 2 comprising the preferred embodiment of this invention includes a first connector, here represented by a printed circuit board connector 10, and a second mating connector, here represented by a plug connector 40 of the type that can be used to terminate wires in a wiring harness (not shown). One of the connectors, here the plug connector 40 is mounted in a panel opening or cutout 6 located in a panel 4. Although the specific embodiment of the connectors depicted herein are twenty four position connectors, this invention is particularly applicable to any connector configuration containing a large number of mating terminals, including those that contain terminals of different sizes and current carrying capacities. In automotive applications, such high count electrical connectors are often mounted in door trim panels, floor consoles, and headliners, although their use is not limited to such applications. However, when used in such applications, this invention includes both a blind mating capability for aligning contacts during mating and the provision for a mechanical assist member, here in the form of a bolt or jackscrew, to overcome large mating forces due mainly to the relatively large number of mating terminals.

FIG. 1 shows both the mating face 44 of the plug connector 40 mounted in the panel cutout 6 and a portion of the mating face 14 of the header 10. A portion of the header shroud 20 has been broken away for illustration purposes to show both the mating portion of header pin terminals 22 and the central header alignment protrusion or post 30. A wire dress cover 80 that is mounted on the rear of the plug connector housing 40 is also shown. Wire dress can be hermaphroditic so that wires can extend outward either to the right or left side of the connector.

The header connector 10 includes both a molded header housing 12 (FIG. 2) and a plurality of male terminals or pins 22 that extend between the header mating face 14 to the header rear face 16. The pins 22 can be positioned in the housing 12 by a number of conventional means, but the pins 22 would normally be inserted into openings in the housing to form an interference fit to secure the terminals in the housing. Header 10 is the type that would normally be mounted on a printed circuit board that would be contained in a component to be mounted on panel 4. The rear portions of pins 22 would be soldered to the printed circuit board, and the opposite end of the pin terminals 22 would be of the type intended to mate with receptacles terminals 50 (FIG. 4) contained in terminals cavities 48 in the plug connector housing 42. Although individual receptacle terminals 50 would be located in individual housing cavities 48, the mating portions of pins 22 would be free standing and the pins would be positioned in an array to mate with the plug connector terminals 50. Although this configuration is commonly used, the unsupported pins 22 can be bent or deformed during mating if the mating terminals are not properly aligned. The pins 22 are surrounded by a shroud 20, partially broken away in FIG. 1 for illustrative purposes and shown complete in FIGS. 2 and 3, encircling the pins 22 in a header mating cavity 18. In this embodiment the terminals 22 are in the form of solid rectangular pins, although it should be understood that these male terminals 22 could be in the form of round wire pins, blades or stamped and formed cylindrical pins. Combinations of different terminals can be used in the same connector or chunk. In addition to its use with a header having straight pins 22, this invention could also be used for right angle headers. Of course when a right angle header is used with a bolt 90 (FIG. 5), the bolt would not extend through the printed circuit board but would instead extend parallel to the printed circuit board.

The pin terminals 22 are arrayed in surrounding relationship to an oblong alignment projection or post 30 located in the center of the header mating face 14 and in the center of the header shroud 20. This central alignment protrusion 30 can be integrally molded with the rest of the header housing 12 and extends forward from the header base section. Protrusion 30 is generally oblong with flat upper and lower sections extending from the header base and with rounded ends. The distal or mating end 32 of the protrusion 30 is tapered to provide inclined surfaces on all four sides that are suitable for aligning or guiding the two connectors during mating. The alignment or guiding post 30 extends beyond both the pins 22 and the header shroud 20 so that the post or projection 30 will be the first to engage the plug connector 40 during mating.

Alignment or guiding post 30 also includes an opening or bore 34 that extends from the mating end of the post 30 through the base of the header so that it extends completely through the header housing 12. This opening or bore 34 is centrally located in the alignment post 30 and is dimensioned to receive a bolt or jackscrew 90 of sufficient size and length to provide mechanical assistance during connector mating.

Figure 2:
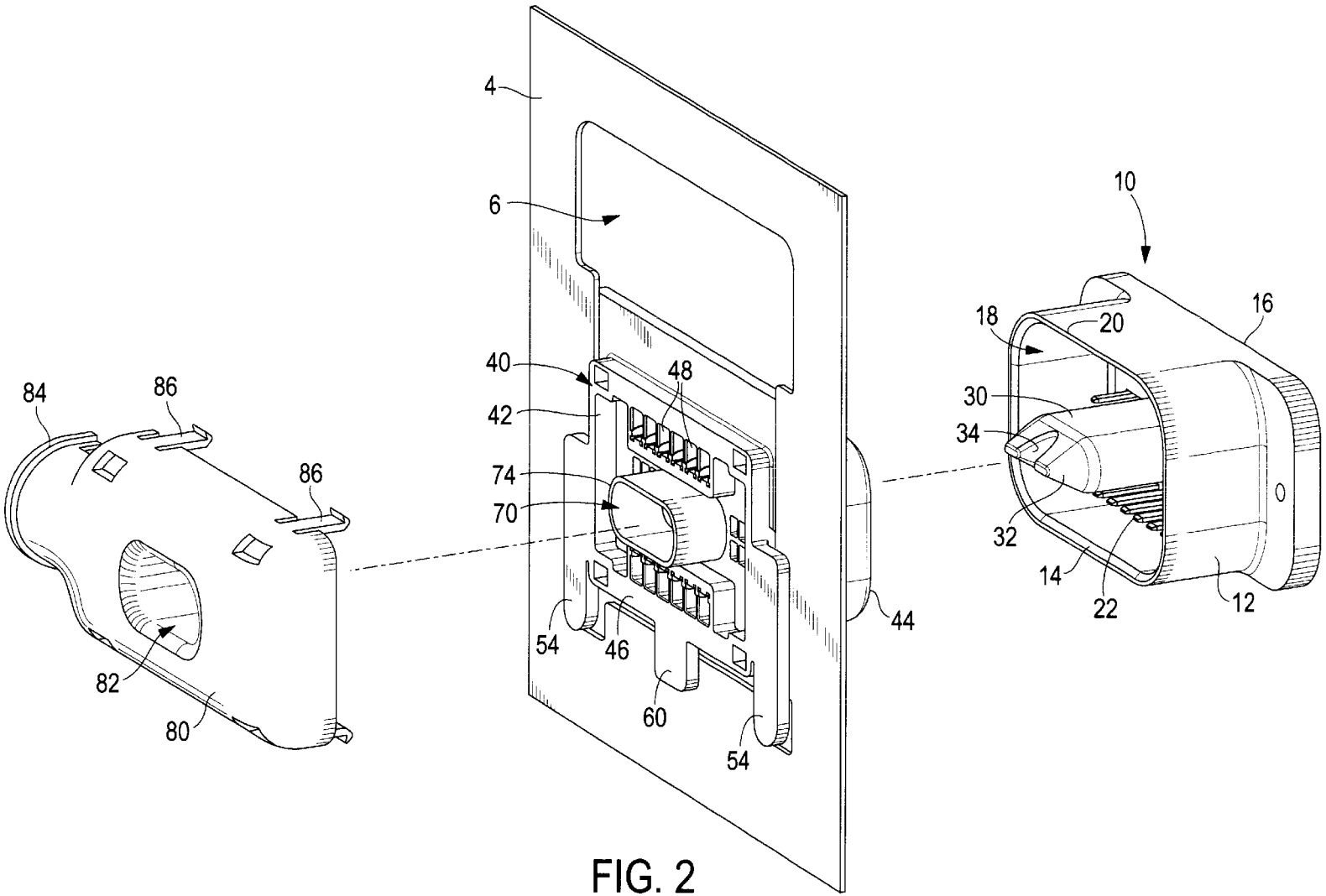
FIG. 2 is a view similar to FIG. 1, but showing the connector components for the opposite direction.
Figure 4:
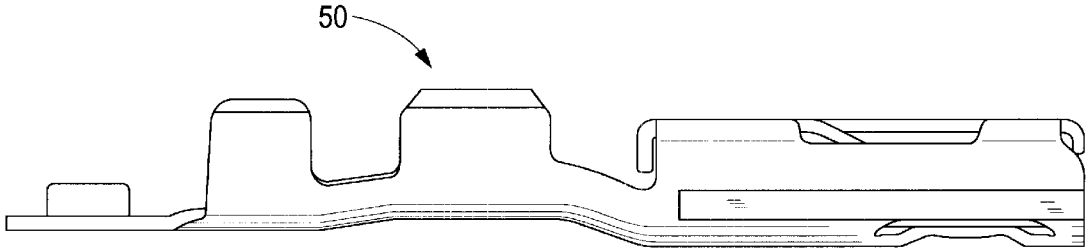
FIG. 4 is a view of a terminal of the type positioned in one of the terminal cavities in the plug connector housing.
Figure 5:
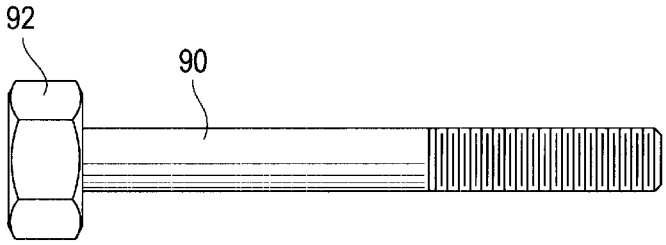
FIG. 5 is a view of a bolt that can be inserted through an opening in the alignment projection of the header and is used to mechanically assist mating the plug connector with the header.

The plug connector 40 also includes a molded housing 42 with a plug mating face 44 that is dimensioned for receipt in the header mating cavity 18 when the two connectors are mated. The header shroud 20 will surround the plug mating face 44. Plug housing 42 also has individual terminal cavities 48 that extend from the plug mating face 44 to the plug rear face 46 (FIG. 2). In the representative embodiment depicted herein, these cavities 48 are configured to receive a stamped and formed receptacle terminal 50 having a mating section and a rear wire crimp section. The receptacle terminal 50 shown in FIG. 4 is merely representative of one of many different conventional terminals that could be used in this invention. The terminal cavities 48 would include molded terminal latches if used with receptacle terminals 50. This invention is not, however, limited to use with this type terminal. Furthermore provisions for secondary locks or receipt of terminal position assurance members could also be included in the plug connector without departing from the invention disclosed by the representative embodiment shown herein.

Figure 3:
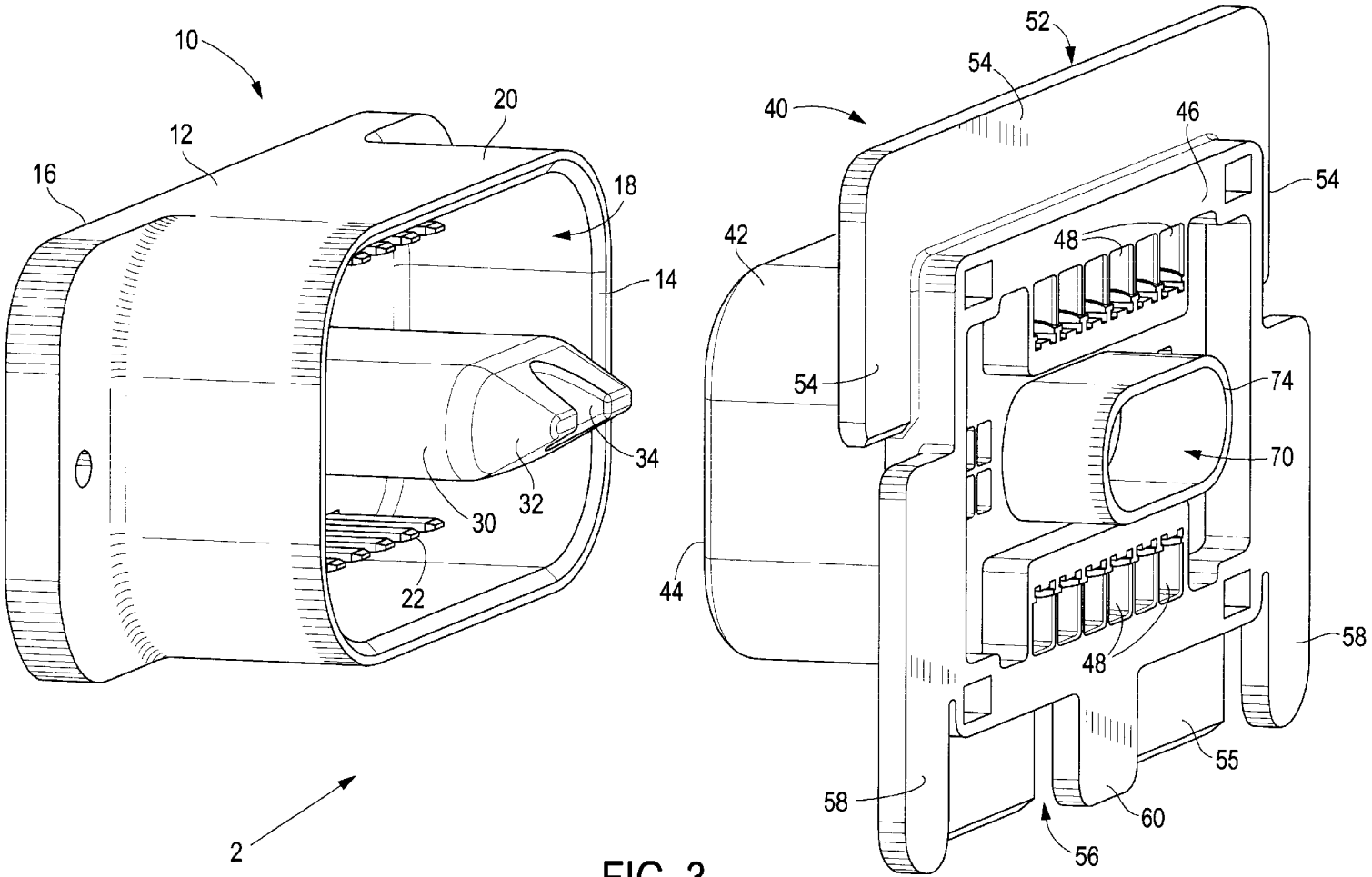
FIG. 3 is a view of the plug connector housing and the header housing.

Plug connector 40 is intended to terminate a plurality of wires in a wiring harness (not shown). Individual wires are crimped to terminals 50 and extend into the terminal cavities 48 through the rear of the housing. With reference to FIGS. 1–3, a wire dress cover 80 is mounted to the rear of the connector housing 42 by snap latches 86. A central hole 82 on the wire dress cover 80 is aligned with the alignment or guiding cavity 70 in the housing 42 so that the guiding protrusion 30 on the mating header 10 can extend through the wire dress cover hole 82 when the header 10 is mated to the plug connector 40. A lateral extension 84 is located at one end of the wire dress cover 80. Extension 84 is intended to gather the individual wires extending from the terminal cavities 48 around the central alignment cavity skirt 74 so that the wires can be bundled into a harness. A conventional wire tie can then be used to secure the wires forming the harness to the extension 84 so that the wires can exit the connector behind the panel 4. The wire dress cover 80 would be attached to the plug housing 42 before the plug connector 40, on one end of an associated wire harness, is mounted in the panel opening 6.

The female terminals 50 and receptacle terminal cavities 48 are located in sections surrounding a central alignment or guiding cavity 70 that extends between the plug mating face 44 and the plug rear face 46. This alignment cavity 70 is configured to receive the male alignment post 30 on the mating header 10. A beveled or tapered front entry is formed on the housing mating face 44 surrounding the alignment cavity 70 to more easily capture the alignment projection 30. Engagement of this beveled entry with the tapered end 32 of post 30 will cause relative lateral movement of the two connectors 10 and 40 as the two connectors are first mated. Since the tapered post end 32 and the beveled entry surround both the male and female alignment members, this relative movement can be in both an X direction and an orthogonal Y direction, both of which are parallel to the plane of the panel 4. In the preferred embodiment, the header 10 is being inserted into the plug 40 so that the initial movement or float will occur in the plug connector. However, during mechanically assisted mating, both the header 10 and the plug 40 can travel relative to the panel 4. The shape of the female alignment cavity 70 to the rear of the beveled entry confirms substantially to the shape of the alignment projection 30. This guiding cavity 70 extends through the main body of the plug housing 42 and through a skirt 74 on the rear of the connector housing 42.

Plug housing 42 also includes a peripheral mounting flange 52 for mounting the plug connector 40 in the panel cutout 6. The panel opening 6 has a relatively larger upper section which is dimensioned to permit insertion of the plug housing and flange 52 through the panel 4. A relatively smaller lower section of cutout 6 is dimensioned so that front and rear sections of the mounting flange 52 fit on opposite sides of the edges of the panel defining the opening 6. The front sections of the flange 52 are shown in FIG. 1 while the rear flange sections are seen in FIG. 2. The front flange includes end flange extensions 54 that overlap side edges of the panel cutout 6. Rear end flanges 58 are located on the lower half of the connector housing 42 are offset relative to the front end flanges 54 by a distance that is slightly greater than the thickness of the panel 4 with which the connector is to be employed. Flange 52 also includes a bottom front section 55 that has a central recess 56 that provides clearance for molding a lower rear flange section 60. These lower flange sections engage opposite sides of the panel 4 adjacent the bottom of the cutout 6. The panel opening 6 also includes laterally extending sections 8. Molded wedges 62 on the front face of rear end flange sections 58 are located within these lateral cutout sections 8 to prevent removal of the plug connector without deflection of the flange sections 58. These wedges 62 are smaller than the lateral open sections 8 so that the plug connector housing can still move or float relative to the panel 4. The size of the connector housing 42 at the inner edge of the peripheral flange 52 is also such that the connector 40 can travel or float relative to the panel 4 when the header 10 is mated to the plug connector 40.

Figure 6:
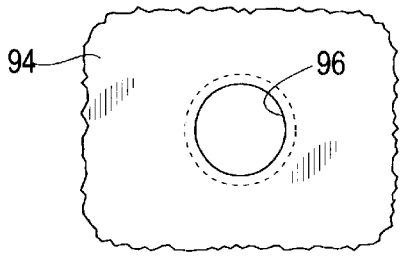
FIG. 6 is a view of a threaded opening in a bulkhead or structural panel that is sized to engage the bolt used to assist mating of the connectors.

Once the two connectors have been aligned and the pins 22 have been aligned with the receptacle terminals 50 located in terminal cavities 48, the connectors can be mated without damage to the freestanding pins 22. However, this assembly also provides a means for overcoming a large mating force. The opening 34 provides space for insertion of a bolt or jackscrew 90 which can be torqued to bring the two connectors into full mating engagement. In the preferred embodiment, the bolt 90 is inserted into the header housing 12 through the rear face 16. The bolt 90 can be inserted after initial alignment and engagement of the two mating connectors. The bolt head 92 can in some applications engage the rear of the printed circuit board on which the header is mounted or it can engage the header itself. Of course the printed circuit board will have an aligned hole for receipt of the bolt 90. In other applications, the header and the printed circuit board will form a part of a larger component and the bolt head 92 could engage the exterior of this component housing. Bolt 90 has sufficient length such that it extends through the alignment post 30 and beyond the mated connector assembly 2. A threaded opening 96 will typically be located behind the panel 4 in a bulkhead or structural panel 94 or in a separate mounting component or bracket. See FIG. 6. The bolt 90 will then be aligned with the fixed opening 96 by moving the bolt 90 and the partially mated connectors 10 and 40. Since the connector assembly 2 is still free to float or move within panel opening 6, the bolt can be aligned even though the panel 4 and the connector assembly 2 located in panel opening 6 are not properly positioned relative to the fixed threaded opening 96. When the bolt 90 is properly aligned, it will be torqued to mechanically assist full mated engagement of the header 10 to the plug connector 40.

In the preferred embodiment of this invention the bolt 90 is inserted first through the header 10 on the front of the panel 4. In this configuration the alignment projection passes through both the plug housing 42 and the wire dress cover 80 so that the mating depth of the connector assembly 2 can be reduced. Another approach, within the scope of this invention would mount the bolt 90 in the plug connector 40. In this alternate embodiment, the alignment post 30 would not extend through the wire dress cover 80. Instead the bolt would be secured in the wire dress cover 80 with the bolt head located on the rear of the wire dress cover 80 which would not have a post clearance hole 82. The threaded portion of the bolt 90 would extend beyond the plug mating face 44 so that the threaded end of the bolt 90 would enter the header alignment projection opening 34. A nut or threaded female cap could then be attached to the bolt 90 and as the nut was progressively rotated around the bolt 90, a mechanically assisted mating force would be applied to the two connectors. This alternate approach would have the advantage that it would not be necessary to align the bolt with a hidden threaded opening behind the panel 4 after the two connectors were partially mated. Although this invention is suitable for use with a bolt as the mechanical assist member, it is not so limited. For example a rod having a cam follower on its distal end could be engaged by a camming member to force the two connectors into a fully mated configuration. More basically, the representative embodiment shows a connector assembly comprising a printed circuit board header that is mated to a wire connector. The same mechanical assist, blind mate approach could also be used for mating two wire connectors to form a wire to wire interconnection. These and other modifications would be apparent to one of ordinary skill in the art and the invention is defined, not by the representative embodiment depicted herein, but by the following claims.

We claim:

1. An electrical connector assembly comprising first and second electrical connectors:

means for mounting one of the first and second electrical connectors on a panel such that the one of the first and second electrical connectors floats in both an X and a Y direction;

a male alignment member on the first electrical connector;

a female alignment member on the second electrical connector, the male and female alignment members being matable such that, during mating of the male and female alignment members the one of the first and second electrical connectors mounted on the panel is free to move in an X and a Y direction into alignment with the other of the first and second electrical connectors;

wherein said means for mounting one of said first and second electrical connectors on the panel comprises non-overlapping, spaced-apart flange members located on front and back surfaces of a base of the one of said first and second electrical connectors;

a wire dress cover mounted on a rear face of said second electrical connector, said wire dress cover having a hole aligned with the female alignment member to permit the male alignment member to pass through the hole when the first and second electrical connectors are mated; and fastener means extending through the male alignment member to mechanically assist mating the first and second electrical connector.

2. The electrical connector assembly of claim 1 wherein the means for mounting the one of the first and second electrical connectors on a panel are located on the second electrical connector.

3. The electrical connector assembly of claim 1 wherein the male alignment member comprises a post extending beyond electrical terminals located in the first electrical connector.

4. The electrical connector assembly of claim 3 wherein the post has a tapered forward end.

5. The electrical connector assembly of claim 4 wherein the post has an oblong exterior configuration and the opening extending through the oblong post has a circular cross section.

6. The electrical connector assembly of claim 1 wherein the opening in the male alignment member extends between a mating face and a rear face of the first electrical connector.

7. The electrical connector assembly of claim 6 wherein the female alignment member comprises an alignment cavity extending between a mating face and a rear face of the second electrical connector.

8. The electrical connector assembly of claim 1 wherein the first electrical connector comprises a printed circuit board header having pin terminals.

9. The electrical connector assembly of claim 8 wherein the second electrical connector comprises a plug connector having receptacle terminals attachable to wires.

10. A blind mate electrical connector assembly including mechanical assist means for mating a first and second electrical connector, the assembly comprising:

a first electrical connector;

a second electrical connector matable with the first electrical connector;

a male alignment protrusion on the first electrical connector;

a female alignment cavity on the second electrical connector configured to receive the male alignment protrusion;

a wire dress cover mounted on a rear face of said second electrical connector, said wire dress cover having a hole aligned with the female alignment cavity to permit the male alignment protrusion to pass through the hole when the first and second electrical connectors are mated; and fastening means extending through the male alignment member to mechanically assist mating the first and second electrical connector.

11. The blind mate electrical connector assembly of claim 10 wherein the fastening means has a length sufficient to engage a treaded opening located behind the second electrical connector and separate from the electrical connector assembly.

12. The blind mate electrical connector assembly of claim 11 wherein the faster means has a head engagable with a rear surface on the first electrical connector, the fastening means being otherwise unattached to the male alignment protrusion.

13. The blind mate electrical connector assembly of claim 12 wherein the male alignment protrusion is centrally positioned in the first electrical connector and the female alignment cavity is centrally positioned in the second electrical connector so that the fastening means is centrally positioned in the assembly.

14. The blind mate electrical connector assembly of claim 10 wherein the second electrical connector includes panel attachment means permitting the second electrical connector to float relative to a panel on which the second electrical connector is mounted.

15. An electrical connector assembly comprising first and second mating electrical connectors:

the first electrical connector including a plurality of pin terminals positioned in a single mating cavity in a first electrical connector housing;

the second electrical connector including a plurality of receptacle terminals, matable with the pin terminals, positioned in individual terminal cavities in a second electrical connector housing;

a central protrusion located in the first electrical connector extending beyond the pin terminals;

a central cavity located in the second electrical connector, configured to receive the central alignment protrusion when the first and second electrical connectors are mated; and a wire dress cover mounted on a rear face of said second electrical connector, said wire dress cover having a hole aligned with the central cavity to permit the central protrusion to pass through the hole when the first and second electrical connectors are mated; and a bolt extending through the central protrusion to mechanically assist mating the first and second electrical connector.

16. The electrical connector assembly of claim 15 wherein the central protrusion and the central cavity comprise means for aligning the pin terminals with receptacle terminals prior to mating engagement to prevent damage to the pin terminals.

17. The electrical connector of claim 15 wherein the second electrical connector housing includes flanges comprising means for mounting the second electrical connector in a panel opening to permit the second electrical connector to float as the central protrusion engages the central cavity to align the pin terminals with the receptacle terminals.

* * * * *